US008026790B2

(12) United States Patent
Fiz et al.

(10) Patent No.: US 8,026,790 B2
(45) Date of Patent: Sep. 27, 2011

(54) DEVICE FOR SAFE DATA TRANSMISSION TO RAILWAY BEACONS

(75) Inventors: Maurizio Fiz, Genoa (IT); Mauro Curotto, Cogorno (IT)

(73) Assignee: Ansaldo STS S.p.A., Genova (IT)

( * ) Notice: Subject to any disclaimer, the term of this patent is extended or adjusted under 35 U.S.C. 154(b) by 1144 days.

(21) Appl. No.: 11/596,402

(22) PCT Filed: May 13, 2005

(86) PCT No.: PCT/EP2005/052206

§ 371 (c)(1),
(2), (4) Date: Mar. 28, 2007

(87) PCT Pub. No.: WO2005/113314

PCT Pub. Date: Dec. 1, 2005

(65) Prior Publication Data

US 2007/0273470 A1 Nov. 29, 2007

(30) Foreign Application Priority Data

May 14, 2004 (IT) ..... TO2004A0325

(51) Int. Cl.
*G05B 23/02* (2006.01)

(52) U.S. Cl. ..... 340/3.31; 714/799

(58) Field of Classification Search ..... 340/3.31
See application file for complete search history.

(56) References Cited

U.S. PATENT DOCUMENTS

| | | | | |
|---|---|---|---|---|
| 4,400,792 | A | 8/1983 | Strelow | |
| 4,622,667 | A | 11/1986 | Yount | |
| 4,734,687 | A | 3/1988 | Jones | |
| 4,745,542 | A * | 5/1988 | Baba et al. | 700/79 |
| 4,763,267 | A * | 8/1988 | Knight et al. | 701/117 |
| 5,548,601 | A * | 8/1996 | Kato et al. | 714/820 |
| 5,794,167 | A * | 8/1998 | Gruere et al. | 701/29 |
| 6,249,171 | B1 * | 6/2001 | Yaklin et al. | 327/382 |
| 6,570,497 | B2 * | 5/2003 | Puckette et al. | 340/539.1 |
| 7,328,369 | B2 * | 2/2008 | Manoni | 714/11 |
| 2002/0121991 | A1 * | 9/2002 | Rostren | 340/988 |

FOREIGN PATENT DOCUMENTS

| | | |
|---|---|---|
| EP | 0 719 689 | 12/1995 |
| EP | 0738973 | 10/1996 |

* cited by examiner

*Primary Examiner* — Jennifer Mehmood
*Assistant Examiner* — Naomi Small
(74) *Attorney, Agent, or Firm* — Gottlieb, Rackman & Reisman, P.C.

(57) ABSTRACT

A device (1) for safe data transmission to railway beacons has a first and a second circuit section (1*a*, 1*b*) independent of and galvanically separate from each other, and each having: a microprocessor (6*a*, 6*b*) selection stage (2*a*, 2*b*) receiving information signals relative to the status of a portion of a railway line, and generating at least one telegram for transmission to a beacon; and a control stage (3*a*, 3*b*) comparing the telegrams generated by the first and second circuit section (1*a*, 1*b*) for enabling/disabling data transmission to the beacon. The first circuit section (1*a*) also has a transmission enabling stage (4, 5, 17), which allows transmission to the beacon of the telegram generated by the first circuit section (1*a*), in the event the comparison performed by the control stage (3*a*, 3*b*) is successful.

8 Claims, 2 Drawing Sheets

DEVICE FOR SAFE DATA TRANSMISSION TO RAILWAY BEACONS

TECHNICAL FIELD

The present invention relates to a device for safe data transmission, in particular safe telegram transmission, to railway beacons.

BACKGROUND ART

As is known, railway beacons (also known by the French term "balise") are installed along railway lines, receive an electromagnetic enabling signal from a vehicle travelling along the railway line, and generate in response a coded response signal (telegram) transmitted to the vehicle and containing information relative to the location and travel of the vehicle.

For example, the information may indicate the presence of an obstacle along a section of the railway line downstream from the beacon location.

Beacons comprise a receiving antenna and a transmitting antenna, and are normally laid between the rails of the railway line and anchored to the sleepers.

Data coding and transmission devices (known as "encoders) are also installed along railway lines to acquire in-field information concerning the status of the railway line, and to transmit an appropriate telegram, selected on the basis of the input signals, to the beacons.

The input signals to the encoder normally come from relay contacts located along the railway line, and which are switched by predetermined events, such as red-to-green switching of a traffic light, point operation, etc.

In other words, the beacons simply provide for relaying telegrams selected and transmitted by the encoders to vehicles travelling along the railway line.

It is therefore essential that the telegrams transmitted to vehicles travelling along a given section of railway line, and on which the safety of the vehicles depends, be fully reliable.

The encoder must therefore ensure a negligible degree of error in both telegram selection on the basis of railway line status, and in selected telegram transmission to the beacons.

DISCLOSURE OF INVENTION

It is an object of the present invention to provide for improved, safer, more reliable telegram selection and transmission to the beacons.

According to the present invention, there is provided a device for safe data transmission to railway beacons, characterized by comprising a first and a second circuit section independent of and galvanically separate from each other, and each comprising: a microprocessor selection stage for receiving information signals relative to the status of a portion of a railway line, and for generating at least one telegram for transmission to a beacon; and a control stage for comparing the telegrams generated by the first and second circuit section, and for enabling/disabling data transmission to said beacon; said first circuit section also comprising a transmission enabling stage, which allows transmission to said beacon of the telegram generated by said first circuit section, in the event the comparison performed by said control stage is successful.

BRIEF DESCRIPTION OF THE DRAWINGS

A preferred, non-limiting embodiment of the invention will be described by way of example with reference to the accompanying drawings, in which.

BEST MODE FOR CARRYING OUT THE INVENTION

Figure 1:
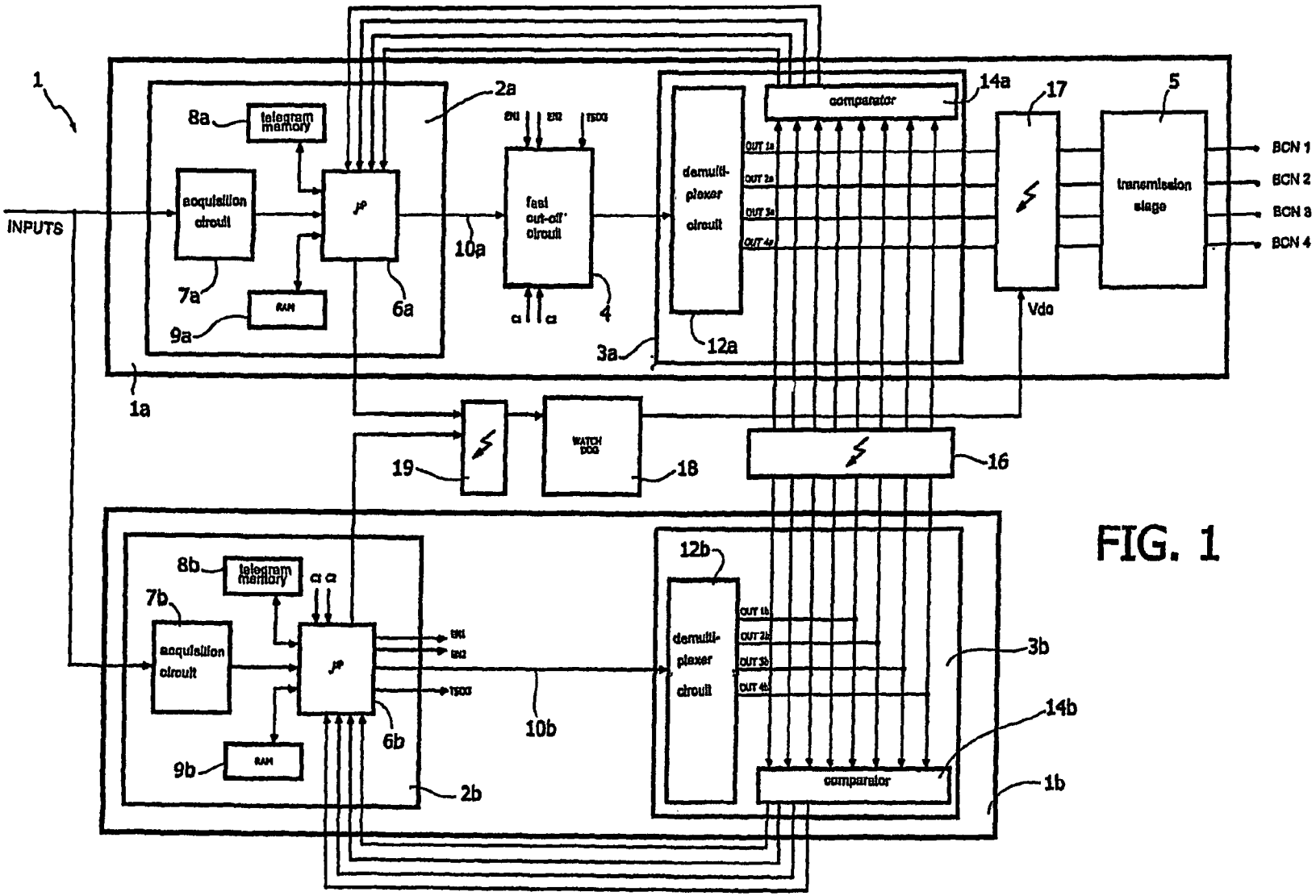
FIG. 1 shows a block diagram of a data transmission device in accordance with the invention.

With reference to FIG. 1, a data transmission device 1 in accordance with the invention comprises a first and a second circuit section 1*a* and 1*b* galvanically isolated from each other and operating in parallel with and independently of each other.

The first circuit section 1*a* transmits telegrams to beacons, while the second circuit section 1*b* tests correct operation of data transmission device 1. More specifically, in the example shown, a data transmission device 1 controls four beacons (BCN1, BCN2, BCN3, BCN4), though the number of beacons controlled may obviously be other than four.

First and second circuit section 1*a*, 1*b* each comprise a selection stage 2*a*, 2*b* for receiving input signals (INPUTS) generated in known manner and relating to the status of a portion of a railway line (e.g. a railway yard, not shown), and for accordingly generating an appropriate telegram for transmission to each beacon.

First and second circuit section 1*a*, 1*b* also each comprise a control stage 3*a*, 3*b* for continuously determining correct operation of data transmission device 1 simultaneously with data transmission to the beacons.

First circuit section 1*a* also comprises a fast cut-off circuit 4 interposed between selection stage 2*a* and control stage 3*a*, and for cutting off data transmission to the beacons in the event of breakdowns; and a transmission stage 5 for transmitting confirmed generated telegrams to the beacons.

More specifically, each selection stage 2*a*, 2*b* comprises a microprocessor 6*a*, 6*b*; an acquisition circuit 7*a*, 7*b* for acquiring input signals indicating the status of the railway line; a telegram memory 8*a*, 8*b* containing a number of previously set telegrams (defined by a succession of bits); and a RAM memory 9*a*, 9*b*.

Acquisition circuits 7*a*, 7*b* receive, fully independently of each other, a number of parallel current or voltage input signals.

Each microprocessor 6*a*, 6*b* receives the signals from respective acquisition circuit 7*a*, 7*b*, and is connected to respective telegram memory 8*a*, 8*b* and to respective RAM memory 9*a*, 9*b*.

More specifically, RAM memory 9*a*, 9*b* is divided into two memory banks, a work memory and a test memory physically separate from each other.

The output of each microprocessor 6*a*, 6*b* is connected to respective control stage 3*a*, 3*b* over a serial transmission channel 10*a*, 10*b*.

Control stage 3*a*, 3*b* comprises a one-input, four-output demultiplexer circuit 12*a*, 12*b*, which receives the signal generated by respective microprocessor 6*a*, 6*b*, and in turn generates four output signals OUT1*a/b*, OUT2*a/b*, OUT3*a/b*, OUT4*a/b*, each for controlling a respective beacon; and a comparing circuit 14*a*, 14*b* for receiving and comparing, bit by bit, the corresponding signals generated by first and second circuit section 1*a*, 1*b*.

More specifically, comparing circuit 14*a*, 14*b* performs a bit-by-bit comparison of signals OUT1*a* and OUT1*b*; OUT2*a* and OUT2*b*; OUT3*a* and OUT3*b*; and OUT4*a* and OUT4*b*.

The result of the bit-by-bit comparison is transmitted by comparing circuit 14*a*, 14*b* to respective microprocessor 6*a*, 6*b*.

A first optoisolator 16 is interposed between the outputs of demultiplexer circuit 12*a* and the inputs of comparing circuit 14*b*, and between the outputs of demultiplexer circuit 12*b* and the inputs of comparing circuit 14*a*, so there is no direct passage of electric signals from first circuit section 1*a* to second circuit section 1*b*, which are thus maintained galvanically isolated.

Figure 2:
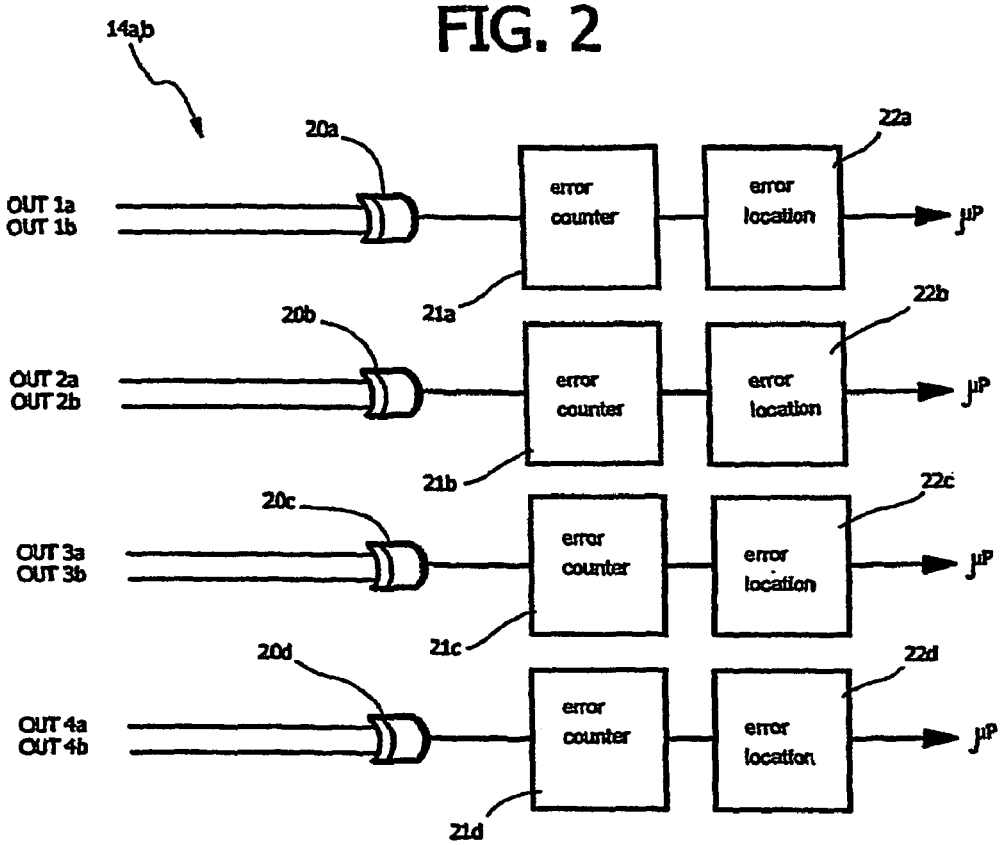
FIGS. 2 and 3 show detailed diagrams of parts of the FIG. 1 device.

FIG. 2 shows the structure of comparing circuit 14*a*, 14*b*.

More specifically, comparing circuit 14*a*, 14*b* comprises four EXOR logic gates 20*a*-20*d* receiving signals OUT1*a* and OUT1*b*, signals OUT2*a* and OUT2*b*, signals OUT3*a* and OUT3*b*, and signals OUT4*a* and OUT4*b* respectively.

Comparing circuit 14*a*, 14*b* also comprises four error counters 21*a*-21*d*, and four error location detectors 22*a*-22*d*. Each error counter 21*a*-21*d* is connected to the output of a respective EXOR logic gate 20*a*-20*d*, and has an output connected to the input of a respective error location detector 22*a*-22*d*, which generates a control signal transmitted to respective microprocessor 6*a*, 6*b*.

Figure 3:
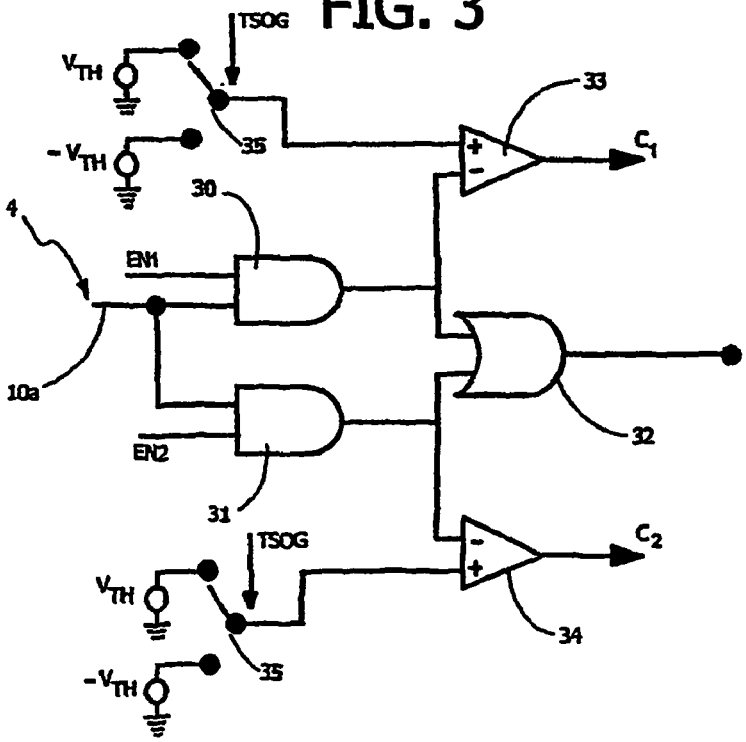

FIG. 3 shows the structure of fast cut-off circuit 4 interposed between the output of microprocessor 6*a* and demultiplexer circuit 12*a* of first circuit section 1*a*.

Fast cut-off circuit 4 comprises a first and a second AND logic gate 30, 31; an OR logic gate 32; and a first and a second threshold comparator 33, 34.

More specifically, first AND logic gate 30 receives the output of microprocessor 6*a* over serial transmission channel 10*a*, and a first enabling signal EN1 generated by microprocessor 6*b*; and second AND logic gate 31 receives the output of microprocessor 6*a*, and a second enabling signal EN2 also generated by microprocessor 6*b*. OR logic gate 32 receives the outputs of first and second AND logic gate 30, 31, and generates a signal which is transmitted to the input of demultiplexer circuit 12*a*.

First and second threshold comparator 33, 34 are connected to the outputs of first and second AND logic gate 30, 31 respectively, and generate a first and a second comparison signal $C_1$, $C_2$, which are read by microprocessor 6*b*. More specifically, first and second comparison signal $C_1$, $C_2$ are the results of comparing the outputs of first and second AND logic gate 30, 31 respectively with a variable threshold voltage.

More specifically, depending on the state of a switch 35 controlled by a control signal TSOG sent by microprocessor 6*b*, the threshold voltage may assume a first positive value ($V_{TH}$) or a second negative value ($-V_{TH}$) opposite the first value.

Transmission stage 5, at the output of first circuit section 1*a*, receives outputs OUT1*a*, OUT2*a*, OUT3*a*, OUT4*a* of demultiplexer circuit 12*a* via the interposition of a second optoisolator 17, and controls four respective beacons.

Data transmission device 1 also comprises a watchdog circuit 18, which receives an enabling signal from each microprocessor 6*a*, 6*b* via the interposition of a third optoisolator 19 to keep microprocessors 6*a*, 6*b* galvanically isolated.

More specifically, watchdog circuit 18 supplies second optoisolator 17 with a supply voltage $V_{dc}$.

Data transmission device 1 operates as follows.

First and second circuit section 1*a* and 1*b* (FIG. 1) receive input signals relative to the status of the railway line independently.

More specifically, acquisition circuit 7*a*, 7*b* acquires and transmits the voltage and current values of the input signals to relative microprocessor 6*a*, 6*b*, and may also acquire a voltage of known value to test correct operation of the acquisition channels.

Each microprocessor 6*a*, 6*b* accesses the two physically separate (work and test) banks of relative RAM memory 9*a*, 9*b*. More specifically, first, work operations are performed on a first bank—the work bank—while a second bank—the test bank—is simultaneously tested. Once testing is completed, the work memory area is copied in the tested second bank, work operations are performed on the second bank, and the first bank is tested. In other words, the two work banks are switched and operation-tested continually with no interruption in the work operations.

On the basis of the data received by respective acquisition circuit 7*a*, 7*b*, microprocessor 6*a*, 6*b* independently selects an appropriate telegram from telegram memory 8*a*, 8*b* on the basis of predetermined (known) internal rules.

More specifically, on the basis of the input data, an appropriate telegram TG1, TG2, TG3, TG4 is generated in known manner for each of the four beacons, and, from the four telegrams TG1, TG2, TG3, TG4, an overall telegram is formed comprising a number of groups of successive bits, each group comprising bits having corresponding locations in the various telegrams. That is, the first group of bits comprises the first bits in telegrams TG1, TG2, TG3, TG4, the second group of bits comprises the second bits in telegrams TG1, TG2, TG3, TG4, and so on up to the end of the telegrams.

The overall telegram so formed is transmitted over serial transmission channel 10*a*, 10*b* at a transmission speed of four times the frequency used to transmit data to the beacons.

A number of beacons (four in the example shown) can thus be controlled over one TDM (Time Division Multiplexing) serial transmission channel for continuous data transmission to the beacons.

Synchronization logic in first and second microprocessor 6*a*, 6*b* synchronizes telegram transmission over serial transmission channels 10*a*, 10*b* using a common clock signal.

The overall telegram generated by microprocessor 6*a*, 6*b* is received by respective demultiplexer circuit 12*a*, 12*b*, which transmits the various bits in each group to respective outputs OUT1*a/b*, OUT2*a/b*, OUT3*a/b*, OUT4*a/b*, so that the respective telegram TG1, TG2, TG3, TG4 to be transmitted to the respective beacon is reconstructed at each output OUT1*a/b*, OUT2*a/b*, OUT3*a/b*, OUT4*a/b*.

Demultiplexer circuit 12*a*, 12*b* performs this operation by means of sequential logic synchronous with the clock signal by which data is transmitted over serial transmission channel 10*a*, 10*b*.

The four reconstructed telegrams at outputs OUT1*a/b*, OUT2*a/b*, OUT3*a/b*, OUT4*a/b* are then sent to comparing circuits 14*a*, 14*b*.

Comparing circuits 14*a*, 14*b* make a bit-by-bit comparison of the telegrams TG1, TG2, TG3, TG4 transmitted by first circuit section 1*a*, and the telegrams TG1, TG2, TG3, TG4 transmitted by second circuit section 1*b*, to determine matching of the transmitted data.

In fact, in the absence of faults in data transmission device 1, the telegrams generated independently by microprocessors 6*a*, 6*b* from the same input signals should match.

More specifically (FIG. 2), the bits in the same locations in each telegram TG1, TG2, TG3, TG4 generated by the two circuit sections 1*a* and 1*b* are compared in EXOR logic gates 20*a*-20*d*, which only generate a low logic value if the compared bits have the same value.

The output signal from EXOR logic gate 20*a*-20*d* is received by error counter 21*a*-21*d* and by error location detector 22*a*-22*d*, which respectively memorize the number of errors detected and their locations within the transmitted telegram. More specifically, error counter 21*a*, 21*d* increments the number of detected errors each time it receives a high logic signal from relative EXOR gate 20*a*-20*d*.

The data memorized in error counters 21*a*-21*d* and in error location detectors 22*a*-22*d* is then transmitted to respective microprocessor 6*a*, 6*b* in the form of control signals to indicate the presence, if any, of data transmission errors.

More specifically, each microprocessor 6*a*, 6*b* receives the control signals generated by respective comparing circuit 14*a*, 14*b* independently.

If no errors are detected, telegrams TG1, TG2, TG3, TG4 at the four outputs OUT1*a*, OUT2*a*, OUT3*a*, OUT4*a* of demultiplexer circuit 12*a* are transmitted via optoisolator 17 to transmission stage 5 to control the respective beacons.

Optoisolator 17, which permits passage of the output data, is supplied with voltage $V_{dc}$ by watchdog circuit 18, which is enabled by enabling signals from microprocessors 6*a*, 6*b*.

Conversely, if any data transmission errors are detected, the following actions are performed to prevent erroneous telegrams being transmitted to the beacons, and to prevent any moving vehicles from receiving and coding potentially hazardous messages:

- first microprocessor 6*a* interrupts data transmission over serial transmission channel 10*a;*
- both microprocessors 6*a*, 6*b* interrupt transmission of the enabling signals to watchdog circuit 18, thus cutting off supply voltage Vdc to optoisolator 17 and so disabling passage of the telegrams to transmission stage 5; and
- second microprocessor 6*b* activates fast cut-off circuit 4, which cuts off data transmission from the output of microprocessor 6*a* to the input of demultiplexer circuit 12*a*.

More specifically (FIG. 3), fast cut-off circuit 4 operates as follows.

Second microprocessor 6*b* supplies fast cut-off circuit 4 continuously with enabling signals EN1 and EN2, which, in the event transmission device 1 is operating correctly, enable data transmission via AND logic gate 30 (high logic state of enabling signal EN1 and low logic state of enabling signal EN2) or via AND logic gate 31 (high logic state of enabling signal EN2 and low logic state of enabling signal EN1). The outputs of AND logic gates 30, 31 are connected to the inputs of OR logic gate 32, so that data flows continuously at the fast cut-off circuit output.

When errors are detected calling for an interruption in data transmission, second microprocessor 6*b* disables both AND logic gates 30, 31 by supplying both enabling signals EN1, EN2 with a low logic state.

The presence of two input AND logic gates 30, 31 allows operation of fast cut-off circuit 4 to be tested simultaneously with data transmission.

That is, second microprocessor 6*b* alternately enables transmission via AND logic gate 30 and determines the output of AND logic gate 31 is actually disabled, and then enables transmission via AND logic gate 31 and determines the output of AND logic gate 30 is actually disabled.

These checks are performed by second microprocessor 6*b* by acquiring first and second comparison signal $C_1$, $C_2$ from comparators 33, 34.

For which purpose, microprocessor 6*b* is designed to trip switch 35 (via control signal TSOG), thus changing the threshold of comparators 33, 34, and to check the output level of AND logic gates 30, 31 is disabled.

More specifically, when AND logic gate 30 is disabled the check is made by reading output $C_1$ of respective comparator 33 alongside a change in its input threshold voltage. The output of AND logic gate 30 (disabled) therefore assumes a reference value (e.g. zero) which is sent to an input of comparator 33, the second input of which receives the positive or negative threshold voltage ($V_{TH}$, $-V_{TH}$), so that actual disabling of the output of AND logic gate 30 can be determined by simply determining switching of the output of comparator 33 alongside a change in the threshold voltage.

The same also applies to determine actual disabling of AND logic gate 31.

Data transmission device 1 also provides for testing operation of comparing circuits 14*a*, 14*b*, particularly the error detecting and storage circuits, simultaneously with telegram transmission to the beacons.

More specifically, microprocessor 6*b* inserts into the telegram transmitted over serial transmission channel 10*b* a sequence of errors of known number and in predetermined locations within the telegram.

This is possible, in that, the telegrams actually sent to the beacons are those generated by microprocessor 6*a* and transmitted over serial transmission channel 10*a*, and which contain no errors.

Once a given number of bits in the telegrams have been transmitted, each microprocessor 6*a*, 6*b* independently checks the number and location of the programmed errors (in the test error sequence) match those of the errors actually detected.

Correct operation of comparing circuits 14*a*, 14*b* can thus be tested, and telegram transmission interrupted in the event the detected errors fail to match.

The advantages of the present invention will be clear from the foregoing description.

In particular, using two independent, galvanically isolated circuit sections for acquiring input signals and generating respective telegrams independently, and two independent comparing circuits for comparing and ensuring the two generated telegrams match, safe data transmission to the beacons is greatly enhanced.

If any errors are detected, the data transmission device according to the present invention provides for three mutually cooperating ways of interrupting data transmission as fast as possible:

- interrupting data transmission over the output serial channel;
- enabling the fast cut-off circuit; and
- disabling the watchdog circuit to cut off supply to the output optoisolator and therefore data transmission to the beacons.

Moreover, by virtue of an appropriate circuit configuration, the data transmission device provides for continuously testing its own operation with no interruption in data transmission to the beacons.

More specifically, it tests operation of the input signal acquisition circuits, of the microprocessor RAM work memories, of the comparing and transmission error detection circuits, and of the fast cut-off circuit.

Clearly, changes may be made to what described and illustrated herein without, however, departing from the scope of the present invention as defined in the accompanying Claims.

In particular, a device other than the one shown may be provided to select the telegrams to be transmitted to the beacons on the basis of the status of the railway line.

In which case, the data transmission device may be supplied directly with a pointer indicating the location of the telegram for transmission within the telegram memory.

Though the embodiment described relates to a transmission device controlling four beacons, a larger number of beacons may be controlled by simply using different electronic components (e.g. a demultiplexer circuit with more outputs).

The invention claimed is:

1. A device (1) for safe data transmission to railway beacons, characterized by comprising a first and a second circuit section (1*a*, 1*b*) independent of and galvanically separate from each other, and each comprising:

a microprocessor (6*a*, 6*b*) selection stage (2*a*, 2*b*) configured to receive information signals relative to the status of a portion of a railway line, and to generate at least one telegram for transmission to a beacon; and a control stage (3*a*, 3*b*) configured to compare the telegrams generated by the first and second circuit section (1*a*, 1*b*) for enabling/disabling data transmission to said beacon;

said first circuit section (1*a*) also comprising a transmission enabling stage (4, 5, 17), configured to allow transmission to said beacon of the telegram generated by said first circuit section (1*a*), in the event the comparison performed by said control stage (3*a*, 3*b*) is successful;

wherein said transmission enabling stage (4, 5, 17) comprises a fast cut-off circuit (4) interposed between an output of said microprocessor (6*a*) and said control stage (3*a*) of said first circuit section (1*a*); said fast cut-off circuit (4) preventing passage of said telegram in the event said comparison by said control stage (3*a*, 3*b*) is unsuccessful;

wherein said fast cut-off circuit (4) comprises a first and a second AND logic gate (30, 31), each having a first input (10*a*) to which said telegram is sent; each AND logic gate having a second input, to which an enabling signal (EN1, EN2) from said microprocessor (6*b*) of said second circuit section (3*b*) is sent; said fast cut-off circuit (4) also comprising an OR logic gate (32) receiving the outputs of said AND logic gates (30, 31); and both said enabling signals (EN1, EN2) having a low value in the event said comparison by said control stage (3*a*, 3*b*) is unsuccessful.

2. A device as claimed in claim 1, wherein said fast cut-off circuit (4) also comprises a first and a second threshold comparator (33, 34) receiving the output of said first and second AND logic gate (30, 31) respectively, and each receiving a threshold voltage ($V_{TH}$, $-V_{TH}$) varying in response to a control signal (TSOG) generated by the microprocessor (6*b*) of said second circuit section (3*b*); said first and said second threshold comparator (33, 34) generating a respective control signal ($C_1$, $C_2$) which is sent to the microprocessor (6*a*) of said first circuit section (1*a*) to check correct operation of said fast cut-off circuit (4).

3. A device (1) for safe data transmission to railway beacons, characterized by comprising a first and a second circuit section (1*a*, 1*b*) independent of and galvanically separate from each other, and each comprising:

a microprocessor (6*a*, 6*b*) selection stage (2*a*, 2*b*) configured to receive information signals relative to the status of a portion of a railway line, and to generate at least one telegram for transmission to a beacon; and a control stage (3*a*, 3*b*) configured to compare the telegrams generated by the first and second circuit section (1*a*, 1*b*) for enabling/disabling data transmission to said beacon;

said first circuit section (1*a*) also comprising a transmission enabling stage (4, 5, 17), configured to allow transmission to said beacon of the telegram generated by said first circuit section (1*a*), in the event the comparison performed by said control stage (3*a*, 3*b*) is successful;

wherein said transmission enabling stage (4, 5, 17) comprises an optoisolating circuit (17) interposed between the control stage (3*a*) of said first circuit section (1*a*) and said beacon; said optoisolating circuit (17) cooperating with a watchdog circuit (18), which receives signals from the microprocessors (6*a*, 6*b*) of said first and said second circuit section (1*a*, 1*b*) to disable said optoisolating circuit (17) in the event said comparison by said control stage (3*a*, 3*b*) is unsuccessful.

4. A device (1) for safe data transmission to railway beacons, characterized by comprising a first and a second circuit section (1*a*, 1*b*) independent of and galvanically separate from each other, and each comprising:

a microprocessor (6*a*, 6*b*) selection stage (2*a*, 2*b*) configured to receive information signals relative to the status of a portion of a railway line, and to generate at least one telegram for transmission to a beacon; and a control stage (3*a*, 3*b*) configured to compare the telegrams generated by the first and second circuit section (1*a*, 1*b*) for enabling/disabling data transmission to said beacon;

said first circuit section (1*a*) also comprising a transmission enabling stage (4, 5, 17), configured to allow transmission to said beacon of the telegram generated by said first circuit section (1*a*), in the event the comparison performed by said control stage (3*a*, 3*b*) is successful;

wherein said control stage (3*a*, 3*b*) comprises:

at least one EXOR logic gate (20*a*-20*d*) receiving the telegrams generated by the microprocessors (6*a*, 6*b*) of the first and second circuit section (1*a*, 1*b*) respectively;

an error counter (21*a*-21*d*) having an input connected to the output of said EXOR logic gate (20*a*-20*d*); and an error location detector (22*a*-22*d*) having an input connected to the output of said error counter (21*a*-21*d*), and generating a control signal which is sent to the respective microprocessor (6*a*, 6*b*).

5. A device as claimed in claim 4, wherein said error counter (21*a*-21*d*) and said error location detector (22*a*-22*d*) acquire a test error sequence used to check correct operation of said control stage (3*a*, 3*b*).

6. A device as claimed in claim 5, wherein said test error sequence is generated in the telegram generated by the microprocessor (6*b*) of said second circuit section (1*b*).

7. A device (1) for safe data transmission to railway beacons, characterized by comprising a first and a second circuit section (1*a*, 1*b*) independent of and galvanically separate from each other, and each comprising:

a microprocessor (6*a*, 6*b*) selection stage (2*a*, 2*b*) configured to receive information signals relative to the status of a portion of a railway line, and to generate at least one telegram for transmission to a beacon; and a control stage (3*a*, 3*b*) configured to compare the telegrams generated by the first and second circuit section (1*a*, 1*b*) for enabling/disabling data transmission to said beacon;

said first circuit section (1*a*) also comprising a transmission enabling stage (4, 5, 17), configured to allow transmission to said beacon of the telegram generated by said first circuit section (1*a*), in the event the comparison performed by said control stage (3*a*, 3*b*) is successful;

wherein each said selection stage (2*a*, 2*b*) generates a number of telegrams for transmission to respective beacons; said selection stage (2*a*, 2*b*) forming an overall telegram comprising a number of groups of successive bits, each group comprising bits having corresponding locations in the various telegrams; and said control stage (3*a*, 3*b*) comprising a demultiplexer circuit (12*a*, 12*b*), which receives said overall telegram and transmits the various bits in each group to respective outputs (OUT1*a/b*, OUT2*a/b*, OUT3*a/b*, OUT4*a/b*) so that the respective telegram is reconstructed at each output (OUT1*a/b*, OUT2*a/b*, OUT3*a/b*, OUT4*a/b*).

8. A device as claimed in claim 7, wherein a fast cut-off circuit (4) is interposed between an output of said microprocessor (6*a*) and said demultiplexer (12*a*) of said first circuit section (1*a*); said fast cut-off circuit (4) preventing passage of said overall telegram, in the event said comparison by said control stage (3*a*, 3*b*) is unsuccessful.

* * * * *